US008282309B2

(12) United States Patent
Mettler et al.

(10) Patent No.: US 8,282,309 B2
(45) Date of Patent: Oct. 9, 2012

(54) INERTIAL BARRIER

(75) Inventors: Charles M. Mettler, Perry, OH (US); Gregory H. Brown, Stow, OH (US)

(73) Assignee: Plastic Safety Systems, Inc., Cleveland, OH (US)

( * ) Notice: Subject to any disclaimer, the term of this patent is extended or adjusted under 35 U.S.C. 154(b) by 1529 days.

(21) Appl. No.: 11/280,780

(22) Filed: Nov. 16, 2005

(65) Prior Publication Data

US 2007/0110516 A1 May 17, 2007

(51) Int. Cl.
*E01F 13/00* (2006.01)

(52) U.S. Cl. ..... 404/6; 404/9; 404/10

(58) Field of Classification Search ..... 404/6, 9, 404/10; 256/1, 13.1, 59, 65.01, 65.05; 267/139; 188/374; 293/133; 248/188; 116/63 P, 116/63 C, 63 R; 220/4.05; 49/49
See application file for complete search history.

(56) References Cited

U.S. PATENT DOCUMENTS 3,099,244 A * 7/1963 Knapp ..... 116/63 P
3,606,258 A * 9/1971 Fitch ..... 256/13.1
4,073,482 A * 2/1978 Seegmiller et al. ..... 267/139
4,289,419 A * 9/1981 Young et al. ..... 404/6
D270,719 S * 9/1983 Porath et al. ..... D10/109
D276,142 S * 10/1984 Dobrin ..... D10/109
4,557,466 A * 12/1985 Zucker ..... 256/13.1
4,674,431 A * 6/1987 Cory ..... 116/63 P
4,688,766 A * 8/1987 Zucker ..... 256/13.1
4,934,661 A * 6/1990 Denman et al. ..... 256/13.1
5,030,029 A * 7/1991 Johnsen ..... 404/6
5,201,599 A * 4/1993 Kulp et al. ..... 404/6
5,234,280 A * 8/1993 Cowan ..... 404/6
5,306,106 A * 4/1994 Mileti ..... 404/6
5,795,530 A * 8/1998 Monda et al. ..... 264/306
5,927,896 A * 7/1999 Gertz ..... 404/6
6,203,241 B1 * 3/2001 Gertz ..... 404/6
D462,286 S * 9/2002 Perelli ..... D10/113
6,817,805 B2 * 11/2004 Mettler et al. ..... 404/6
D531,081 S * 10/2006 Fan ..... D11/143
2004/0151543 A1 * 8/2004 Mettler et al. ..... 404/9
2005/0025568 A1 * 2/2005 Mettler et al. ..... 404/9

* cited by examiner

*Primary Examiner* — Raymond W Addie
(74) *Attorney, Agent, or Firm* — Renner, Otto, Boisselle & Sklar, LLP

(57) ABSTRACT

An inertial barrier includes a standard size plastic container and a single size insert that is supported by a ledge inside the container for supporting different amounts of sand or other dispersible granular energy absorbing material thereon to achieve different barrier weight configurations. The insert has an axially upwardly, radially inwardly extending top wall that permits some downward flexing of the insert inside the container as the weight of the material that is placed on the insert builds up, causing the sides of the insert to expand and push radially outwardly against the container side wall, preventing the material from leaking past the insert inside the container. Axially extending ribs may be provided in the container side wall for increased strength and rigidity.

19 Claims, 5 Drawing Sheets

INERTIAL BARRIER

FIELD OF THE INVENTION

This invention relates generally to inertial barriers used to attenuate the energy of errant vehicles to limit their effects before striking an obstacle adjacent a roadway such as a bridge abutment or other roadway hazard.

BACKGROUND OF THE INVENTION

Arrays of inertial barriers have long been used to limit the effects of errant vehicles striking an obstacle such as a bridge abutment or other hazard adjacent a roadway. A typical inertial barrier system is comprised of an array of frangible plastic containers that are filled with varying amounts of sand or similar type dispersible granular energy absorbing material in a predetermined fashion so that should an errant vehicle crash into the barrier system, the vehicle will be caused to decelerate gradually hopefully with minimum damage to the vehicle and reduced risk of serious injury to its occupants. Barriers of progressively increased weight are typically employed in the direction toward the obstacle to be protected. Thus an errant vehicle will initially strike the lightest barriers first, which will shatter the barriers and scatter the sand or other granular energy absorbing material inside the barriers, causing the inertia of the errant vehicle to be reduced. As the vehicle continues to slow, it will continue to impact progressively heavier barriers until the vehicle comes to a complete stop, hopefully without serious injury to the occupants and with minimum damage to the errant vehicle and the obstacle being protected.

It is known to utilize different size pedestals or cores inside the barrier units to reduce or increase the interior volume of the barrier units which is available for filling with sand to achieve different barrier weight configurations, and also to maintain the center of gravity of the barrier units at about the same height as the bumper of an errant vehicle, which is typically about two feet above the roadway. This prevents the errant vehicle from ramping or climbing over the barriers or from nosing under the barriers during impact. However, this has the disadvantage that an inventory of the different sizes of pedestals or cores must be maintained in order to construct barrier units of the desired weight configurations.

It is also known to employ a single size core inside a standard size container for obtaining different barrier weight configurations without having to use different sized pedestals or cores. However, this has the disadvantage that because of the shape of the core, the orientation of the core must be reversed for achieving all of the desired barrier weight configurations.

SUMMARY OF THE INVENTION

The present invention addresses the foregoing problems by providing an inertial barrier that utilizes a standard size frangible or deformable plastic container and a single size insert that fits inside the container in only one orientation to achieve the desired lighter weight barrier configurations, and the insert is not utilized to achieve the desired heavier weight barrier configurations.

In accordance with one aspect of the invention, the container has a bottom wall and open top and a side wall having a ledge extending laterally inwardly therefrom in spaced relation from the bottom wall and open top for supporting an insert thereon used to support a suitable dispersible granular energy absorbing material such as sand above the insert inside the container. The insert has an axially upwardly, radially inwardly extending top wall and is made of a suitable plastic material that permits some downward flexing of the insert inside the container as the weight of the material that is placed on top of the insert builds up, causing the insert to expand and push radially outwardly against the side wall, preventing the material from leaking past the insert.

In accordance with another aspect of the invention, the insert may be roto-molded out of a suitable plastic material such as high density polyethylene.

In accordance with another aspect of the invention, the container side wall may have a plurality of circumferentially spaced axially extending ribs to give added strength and rigidity to the side wall.

In accordance with another aspect of the invention, at least some of the ribs may have upper ends extending laterally inwardly in alignment with the ledge to provide additional support for the insert when a fill of the material is placed on top of the insert inside the container.

In accordance with another aspect of the invention, the container side wall may include an upper side wall portion having an axially extending lower inner end portion and a lower side wall portion having an inwardly tapered uppermost inner end portion that forms a smooth transition with the lowermost inner end portion of the upper side wall portion.

In accordance with another aspect of the invention, the upper side wall portion may be stepped laterally inwardly at discrete intervals along its height from the open top, and the lower side wall portion may taper inwardly throughout its height from its uppermost end to the container bottom wall to facilitate stacking of a plurality of such containers during transit and storage.

In accordance with another aspect of the invention, the lowermost stepped surface of the upper side wall portion may have a generally rectangular cross sectional shape, and the stepped surface immediately above the lowermost stepped surface may have a cylindrical cross sectional shape that provides laterally outwardly extending flanges immediately above the lowermost stepped surface that may be engaged by a generally U-shaped lifting yoke for use in moving the container from one location to another or for tipping the container to dump the dispersible granular energy absorbing material from the container.

These and other objects, advantages, features and aspects of the present invention will become apparent as the following description proceeds.

To the accomplishment of the foregoing and related ends, the invention, then, comprises the features hereinafter more fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION OF THE INVENTION

Figure 1:
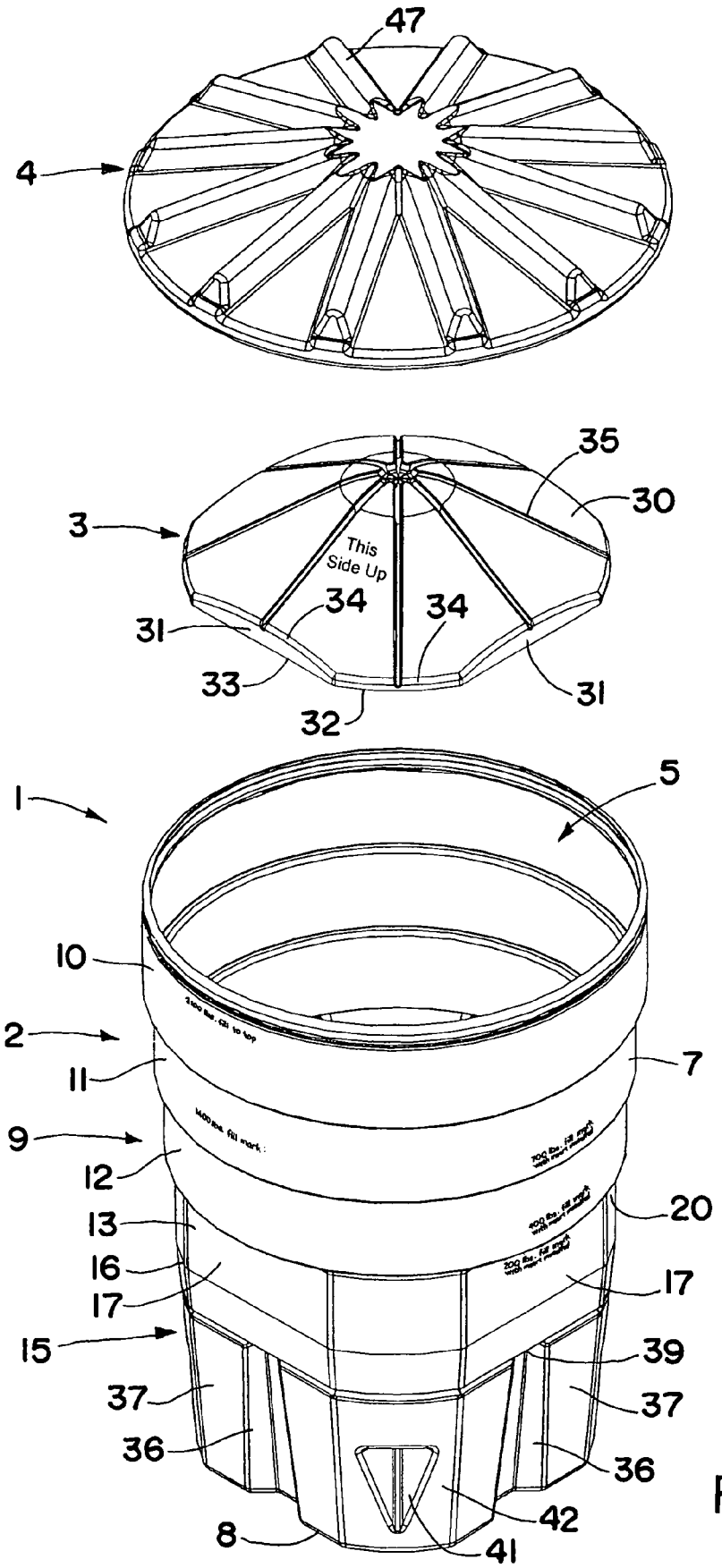
FIG. 1 is an exploded perspective view of one form of inertial barrier in accordance with the present invention including an open top container, an insert that is positionable inside the container, and a cover or lid for the container.

Referring now more particularly to the drawings, wherein like reference numerals are used to designate like parts, and initially to FIG. 1, there is shown one form of inertial barrier 1 of the present invention including an open top container 2, an insert 3 that is selectively positionable inside the container, and a cover or lid 4 that fits over the open top 5 of the container. When positioned inside the container, the insert 3 is supported by a ledge 6 (see FIG. 6) extending laterally inwardly from the container side wall 7 in spaced relation from the container bottom 8 and open top 5 for selectively supporting various amounts of sand (or other suitable dispersible granular energy absorbing material) above the insert to maintain the center of gravity of the barrier at about the same height as the bumper of an errant vehicle. All three of these elements may be molded out of a suitable plastic material such as high density polyethylene that is frangible or sufficiently deformable upon impact by a high speed errant vehicle such that the sand (or other dispersible granular energy absorbing material) inside the container will be dispersed, causing the vehicle to decelerate as well known in the art.

The container side wall 7 includes an axially extending upper side wall portion 9 that may be stepped laterally inwardly at discrete intervals along its height from top to bottom to provide a plurality of axially inwardly stepped surfaces 10-13, and a lower side wall portion 15 that may taper inwardly throughout its height from its uppermost end 16 to the bottom wall 8 of the container to facilitate stacking of the containers for ease of transport to and from a job site and for storage. Another advantage in providing the upper side wall portion 9 with axially extending stepped surfaces is that it makes it easier to apply reflective sheeting material to one or more of the stepped surfaces. The number and height of each stepped surface may vary according to the overall height of the upper portion of the container. For example, the upper side wall portion 9 may have an overall height of approximately 26 to 27 inches, and the upper side wall portion may have a total of four stepped surfaces 10-13, each having a height for example of between approximately 6½ and 7 inches.

Figure 8:
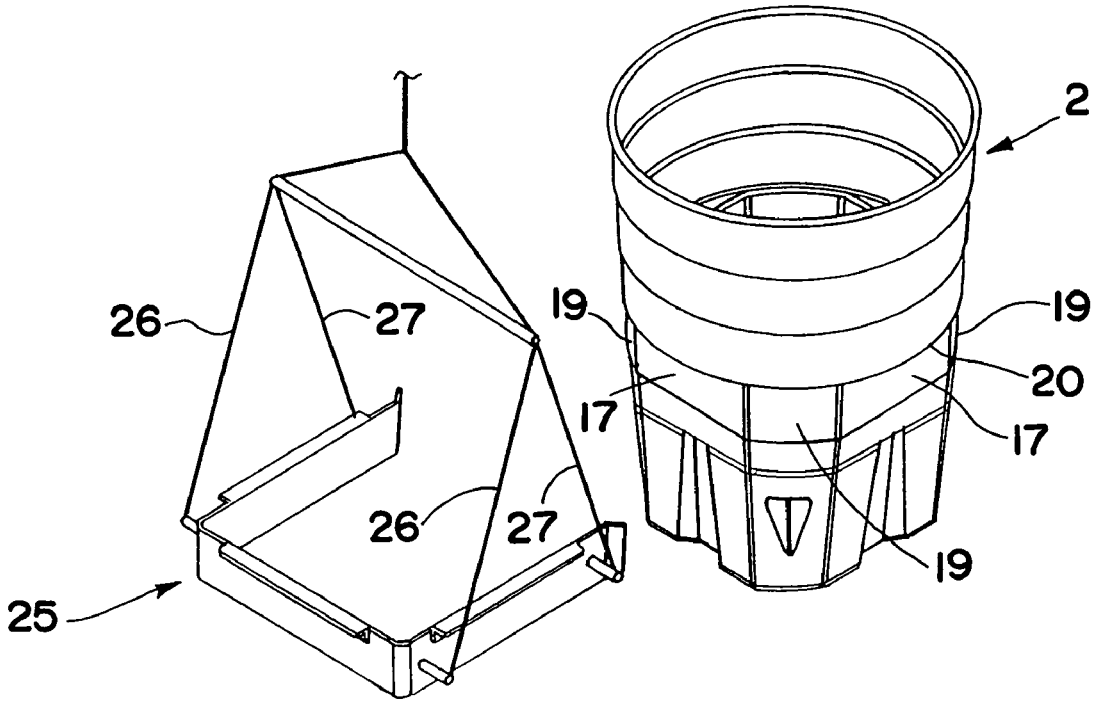
FIG. 8 is a schematic perspective view of the container of FIG. 1 and a U-shaped lifting yoke that may be used to move the container from one location to another.
Figure 9:
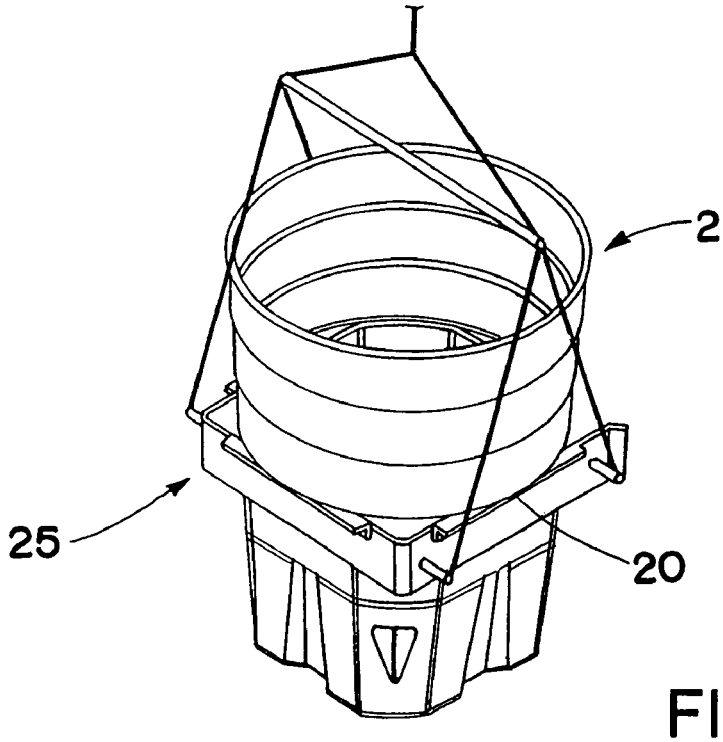
FIG. 9 is a schematic perspective view similar to FIG. 8 but showing the lifting yoke in position for lifting the container.

The lowermost stepped surface 13 may be generally rectangular (e.g., square) shaped with parallel opposite sides 17 and rounded corners 19 between the sides, whereas the other stepped surfaces 10-12 may be cylindrical. Moreover, the lowermost generally rectangular stepped surface 13 may have a width between opposite sides that is for example approximately 5 inches less than the diameter of the stepped cylindrical surface 12 immediately above the rectangular stepped surface to provide relatively wide laterally outwardly extending flanges 20 above the rectangular stepped surface for engagement by a generally U-shaped lifting yoke 25 (shown in FIGS. 8 and 9) to keep the container from tipping when filled with sand during movement by the lifting yoke and allowing the sand to be dumped from the container by releasing two of the support chains 26, 27 attached to one side of the yoke.

The cylindrical stepped surfaces 11, 12 may each have a diameter for example of approximately one and a half inches less than the immediately adjacent cylindrical stepped surface from top to bottom. For example, the uppermost stepped surface 10 may have a diameter of approximately 36 inches and the next two cylindrical stepped surfaces 11 and 12 may have diameters of approximately 34½ inches and 33 inches, respectively. Also the tepped surface 13 may have a maximum width of approximately 28 inches.

Figure 4:
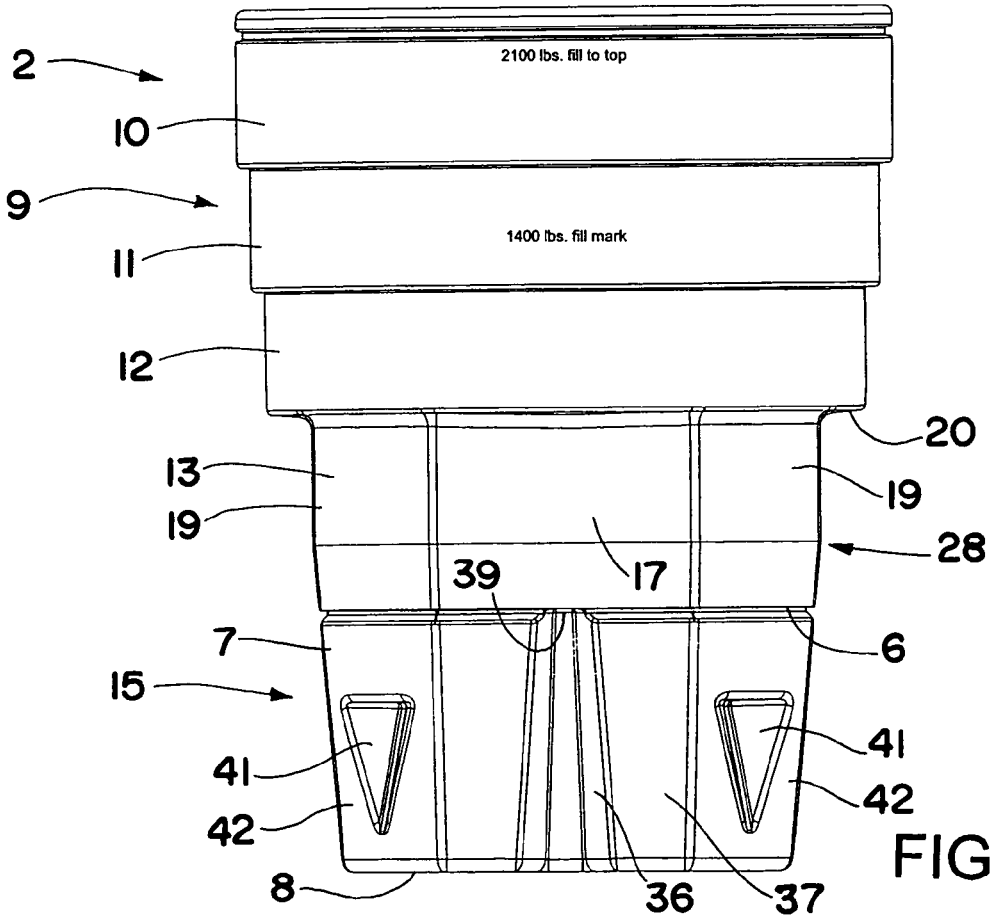
FIG. 4 is a side elevation view of the container of FIG. 1.
Figure 7:
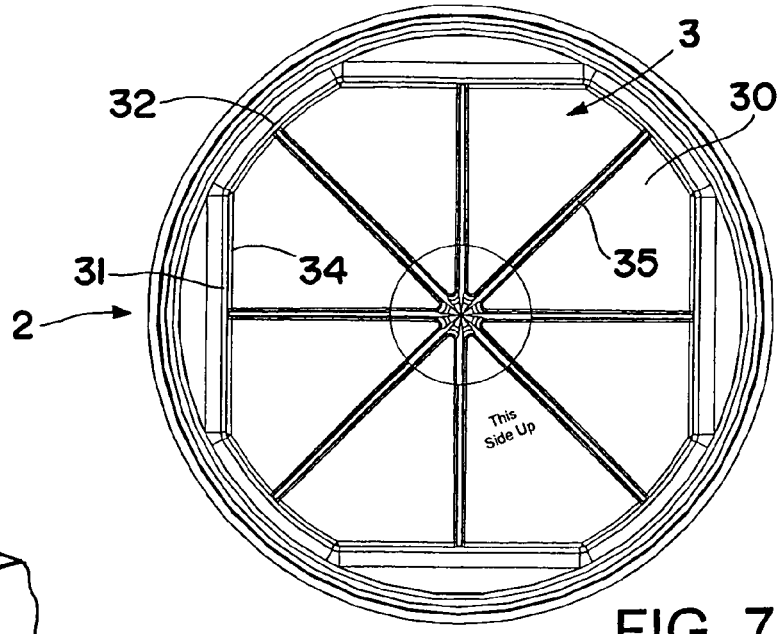
FIG. 7 is a top plan view of the container similar to FIG. 5 but showing the insert in place inside the container.

The lower side wall portion 15, which may be tapered axially inwardly toward the bottom substantially throughout its height, has a cross-sectional shape substantially corresponding to the cross-sectional shape of the lowermost stepped surface 13 (e.g., generally square with rounded corners) so as to form a smooth transition 28 therebetween (see FIG. 4).

Figure 2:
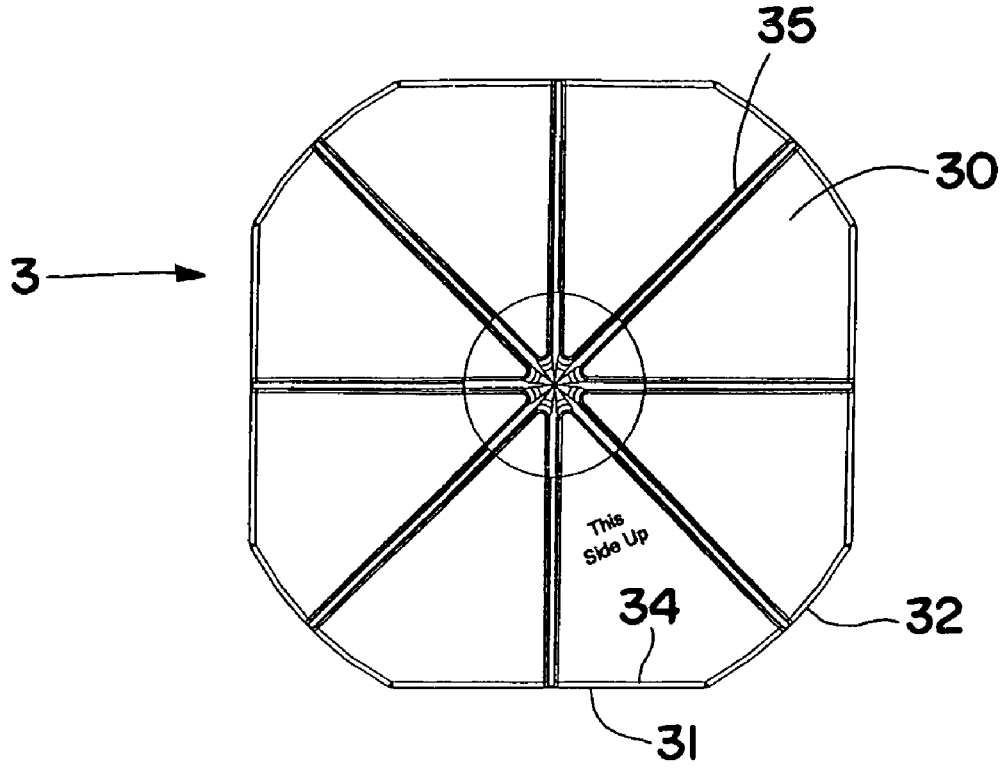
FIG. 2 is a top plan view of the insert of FIG. 1.
Figure 3:
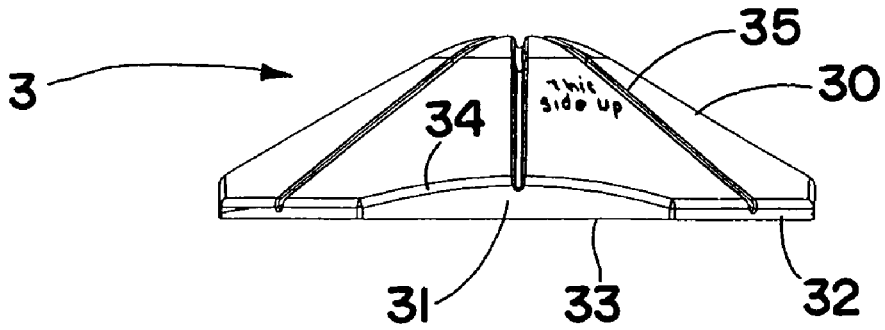
FIG. 3 is a side elevation view of the insert as seen from the front of FIG. 2.
Figure 5:
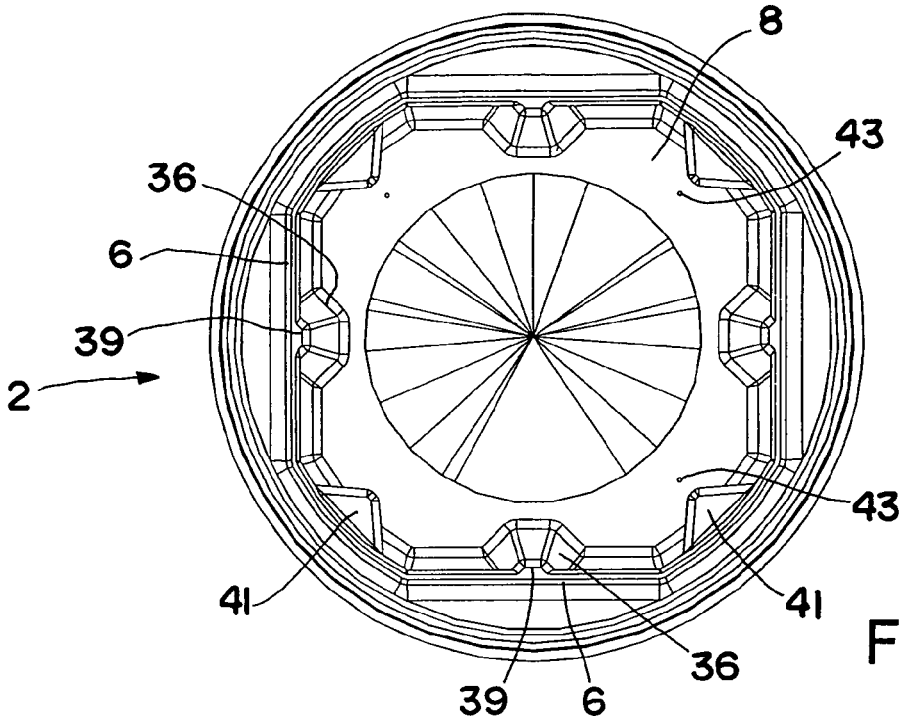
FIG. 5 is a top plan view of the container of FIG. 4.
Figure 6A:
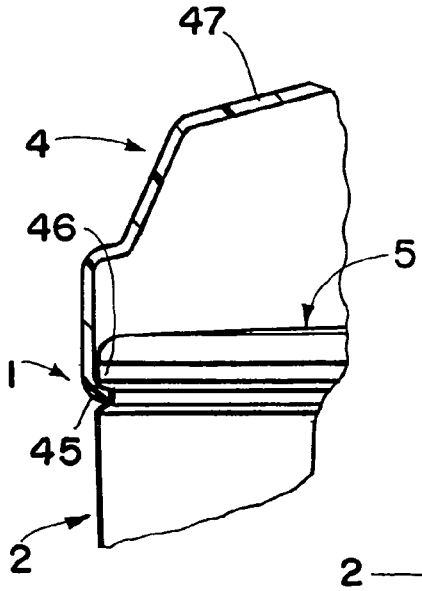
FIG. 6*a* is an enlarged fragmentary side elevation view, partly in section, of the open upper end of the container and container cover of FIG. 6.
Figure 6:
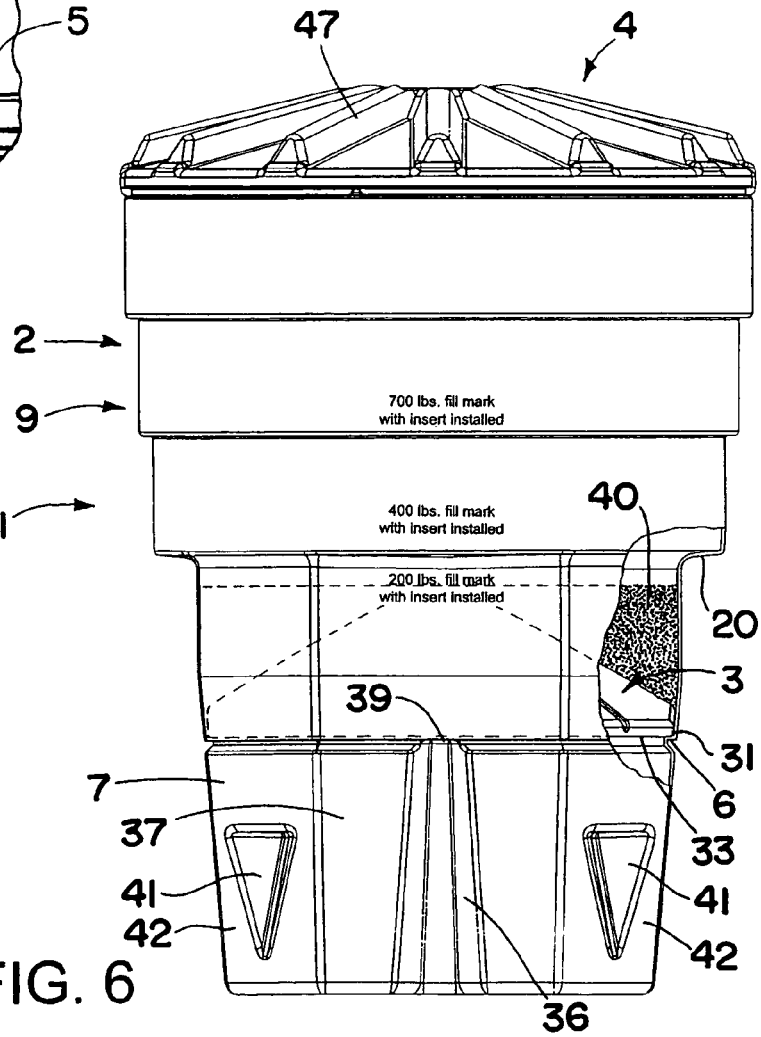
FIG. 6 is a side elevation view of the inertial barrier of the present invention with portions of the container side wall broken away to show the insert supported by a ledge extending laterally inwardly from the side wall in spaced relation from the open top and bottom wall of the container and a fill of sand or other dispersible granular energy absorbing material placed on top of the insert.

Insert 3 has an axially upwardly, radially inwardly extending top wall 30 which may be of a generally frustoconical shape with straight opposite side edges 31 and rounded corners 32 as shown in FIGS. 1-3 that are sized and shaped to substantially match the cross-sectional shape of the lower side wall portion 15 immediately above the ledge 6 so that its trimmed lower edge 33 fits on and is supported by the ledge as shown in FIG. 6. Ledge 6 may be molded into the lower side wall portion 15 as further shown in FIG. 6. The height of the ledge 6 above the bottom wall 8 of the container may vary depending on the size of the container and the amount of the material that is to be supported by the insert inside the container. Regardless of the size of the container, the height of the ledge should be such that when the insert is inserted into the container and a fill of the material is placed on top of the insert, the center of gravity of the barrier will be at about the same height as the bumper of any errant vehicles that might impact against the barrier.

The weight of the material that is placed on top of the insert forces the insert down into tight engagement with the ledge inside the container, which may, for example, have a width of approximately one-half inch for supporting the insert thereon. Also, while the dimensions of the insert 3 may vary depending on the size of the container, in one form of the invention, the insert may have an overall vertical height of between approximately 8 and 8¼ inches and the side edges 31 and rounded corners 32 may have a height of approximately one-half inch and rounded upper edges 34. Moreover, the top wall 30 of the insert may have a taper of approximately 60° from the vertical to give it the desired rigidity and still allow it to flex slightly under load as the amount of the material on top of the insert builds up, causing the sides 31 and 32 of the insert to expand and push radially outwardly against the container side wall, preventing the material from leaking between the insert and container side wall into the bottom of the container.

To insure that the insert does not make the container too rigid to deform when impacted by an errant vehicle to cause the lid to come off and the sand within the container to be dispersed out through the open top, the insert may be roto-molded out of a suitable plastic material such as high density polyethylene so it more easily flexes or cracks upon impact by the errant vehicle.

A plurality of circumferentially spaced, radially extending ribs 35 may be integrally formed with the top wall 30 of the insert 3 as shown in FIGS. 1-3 and 7 to give the insert added strength and rigidity. Also the lower side wall portion 15 of the container 2 may be provided with a plurality of circumferentially spaced, axially extending ribs 36 as shown in FIGS. 1 and 4-6 to give added strength and rigidity to the lower side wall portion. In the embodiment disclosed herein, each of the straight sides 37 of the lower side wall portion 15 has an integrally formed vertically extending rib 36 that may progressively increase in width and depth from top to bottom and may extend all the way to the bottom wall 8 of the container. Also the upper ends 39 of the ribs 36 may extend laterally inwardly substantially in alignment with the ledge 6 to provide additional support for the insert 3 inside the container when a fill of sand (or other granular energy absorbing material) 40 is placed on top of the insert as schematically shown in FIG. 6.

Additional reinforcing ribs 41 may be provided in the curved sides 42 of the lower side wall portion 15 of the container that may be substantially shorter in length than the ribs 36 and wider at the top and narrower at the bottom as shown in FIGS. 1, 4 and 6.

The bottom wall 8 of container 2 may be provided with drain holes 43 (see FIG. 5) to permit drainage of any water from the container that might be contained in the sand when placed into the container or that might enter through the open top of the container before the lid 4 is secured in place and flows between the insert and container side wall into the bottom of the container.

Lid 4 may be generally dome shaped to shed water, and may have a locking flange 45 around its periphery to provide a snap fit over a lip 46 around the upper open end 5 of the container as schematically shown in FIG. 6*a*. Circumferentially spaced radially extending reinforcing ribs 47 may also be provided on the top of the lid for added strength.

An inertial barrier array for stopping errant vehicles before striking a roadway hazard such as a bridge abutment or the like may be constructed by filling a plurality of the containers 2 of the present invention with different amounts of sand, with or without the inserts in place, depending on where the barriers are to be placed in the array. In a typical installation, barrier units of progressively higher weight are employed in the direction toward the hazard. The lighter weight barriers (e.g., from 200 lbs. to 700 lbs.) are used to provide the initial phase of deceleration of the errant vehicle followed by barriers of progressively heavier weights (e.g., from 1400 lbs. to 2100 lbs.). The lighter weight barriers are constructed by installing inserts 3 inside the containers and filling the containers up to respective fill marks that may be embossed or otherwise placed on the outside of the containers (e.g., a 200 pound fill mark, a 400 pound fill mark, and a 700 pound fill mark with the insert installed). For the heaviest barriers which are located nearest the obstacle to be protected, the containers are filled to the desired fill mark (for example a 1400 lb. fill mark and a 2100 lb. fill mark to the top) on the outside of the containers without using the inserts. These heavier barriers will not be impacted until the errant vehicle has been considerably slowed down by the lighter inertial barriers located further away from the hazard, hopefully enough that the vehicle will finally be stopped by the barrier array without undue damage to the vehicle and without serious injury to the occupants.

Although the invention has been shown and described with respect to a certain embodiment, it is obvious that equivalent alterations and modifications will occur to others skilled in the art upon the reading and understanding of the specification. In particular, with regard to the various functions performed by the above-described components, the terms (including any reference to a "means") used to describe such components are intended to correspond, unless otherwise indicated, to any component which performs the specified function of the described component (e.g., that is functionally equivalent), even though not structurally equivalent to the disclosed component which performs the functions in the herein exemplary embodiment of the invention. In addition, while a particular feature of the invention may have been disclosed with respect to only one embodiment, such feature may be combined with one or more other features of other embodiments as may be desired or advantageous for any given or particular application.

What is claimed is:

1. An inertial barrier for use in protecting a vehicle from roadway hazards comprising a plastic container having a bottom wall and open top and a side wall, a ledge extending laterally inwardly from the side wall in spaced relation from the bottom wall and open top, and an insert having sides sized and shaped to be supported by the ledge inside the container, the insert having an axially upwardly, radially inwardly extending top wall for supporting a dispersible granular energy absorbing material above the insert inside the container, wherein the container side wall includes a cylindrical upper side wall portion that is stepped laterally inwardly at discrete intervals along its height from the open top, and a generally rectangular lower side wall portion that tapers inwardly from a lowermost edge of the upper side wall portion to the bottom wall to facilitate stacking of a plurality of such containers during transit or storage, wherein the ledge is continuous and extends laterally inwardly from the generally rectangular lower side wall portion substantially to the same lateral extent around the entire periphery of the lower side wall portion and the insert has straight opposite side edges that are sized and shaped to substantially match the cross sectional shape of the lower side wall portion immediately above the ledge.

2. The inertial barrier of claim 1 wherein the top wall of the insert extends axially upwardly and radially inwardly from the sides of the insert for supporting substantially all of the material on the top wall inside the container, and the insert is made of a flexible plastic material that permits some downward flexing of the top wall inside the container as the weight of the material that is placed on the top wall of the insert builds up, causing the sides of the insert to expand and push radially outwardly against the side wall, preventing the material from leaking past the insert.

3. The inertial barrier of claim 2 wherein the top wall of the insert has a generally frustoconical shape.

4. The inertial barrier of claim 2 wherein the insert is roto-molded out of a high density polyethylene.

5. The inertial barrier of claim 2 wherein the insert has a plurality of circumferentially spaced, radially extending ribs integrally formed with the top wall to give the insert added strength and rigidity.

6. The inertial barrier of claim 1 wherein the container side wall has a plurality of circumferentially spaced, axially and inwardly extending ribs to give added strength and rigidity to the container side wall.

7. The inertial barrier of claim 6 wherein the ledge is continuous around an inner periphery of the side wall and at least some of the ribs have laterally inwardly extending upper ends contacting a bottom side of the ledge and extending substantially the full width of the ledge to provide additional support for the insert when a fill of the material is placed on top of the insert inside the container.

8. The inertial barrier of claim 1 wherein the container side wall has a plurality of circumferentially spaced, axially and inwardly extending ribs to give added strength and rigidity to the container side wall, wherein the ledge is continuous around an inner periphery of the side wall and at least some of the ribs have laterally inwardly extending upper ends in substantial alignment with the ledge to provide additional support for the insert when a fill of the material is placed on top of the insert inside the container, and wherein at least some of the axially and inwardly extending ribs progressively increase in width and depth from top to bottom.

9. The inertial barrier of claim 7 wherein at least some of the ribs extend to the bottom wall of the container.

10. The inertial barrier of claim 1 wherein the lower side wall portion immediately above the ledge is generally square with rounded corners, and the insert has straight opposite side edges and rounded corners that are sized and shaped to substantially match the cross sectional shape of the lower side wall portion immediately above the ledge.

11. The inertial barrier of claim 1 wherein the tapered lower side wall portion has circumferentially spaced reinforcing ribs, at least some of the ribs having laterally inwardly extending upper ends contacting a bottom side of the ledge and extending substantially the full width of the ledge to provide additional support for the insert when a fill of the material is placed on top of the insert inside the container.

12. An inertial barrier for protecting an errant vehicle from roadway hazards comprising a plastic container having a bottom wall and open top, and a side wall having upper and lower side wall portions, the upper side wall portion being cylindrical and stepped laterally inwardly at discrete intervals along its length from the open top to a lowermost end of the upper side wall portion to provide a plurality of laterally inwardly stepped axially extending cylindrical surfaces, and the lower side wall portion being generally rectangular in cross section and tapered axially inwardly from an uppermost end of the lower side wall portion to the bottom wall, a continuous ledge extending laterally inwardly from the lower side wall portion substantially to the same lateral extent around the entire periphery of the lower side wall portion in spaced relation from the uppermost end of the lower side wall portion and from the bottom wall, and an insert having straight opposite side edges that are sized and shaped to substantially match the cross sectional shape of the lower side wall portion immediately above the ledge so that the insert fits on the ledge for supporting a dispersible granular energy absorbing material above the insert inside the container.

13. The inertial barrier of claim 12 wherein the insert has a top wall that extends axially upwardly and radially inwardly from the insert side edges for supporting substantially all of the material on the top wall above the insert inside the container, the insert being made of a flexible plastic material that permits some downward flexing of the insert top wall inside the container as the weight of the material that is placed on the insert top wall builds up, causing the sides of the insert to expand and push radially outwardly against the side wall preventing the material from leaking past the insert inside the container.

14. The inertial barrier of claim 12 wherein the lower side wall portion has a plurality of circumferentially spaced axially and inwardly extending ribs to give added strength and rigidity to the lower side wall portion.

15. The inertial barrier of claim 14 wherein at least some of the ribs have laterally inwardly extending upper ends contacting a bottom side of the ledge and extending substantially the full width of the ledge to provide additional support for the insert when fitted on the ledge inside the container and a fill of the material is placed on top of the insert inside the container.

16. An inertial barrier for use in protecting an errant vehicle from roadway hazards comprising a plastic container having a bottom wall and open top and upper and lower side wall portions, the lower side wall portion tapering inwardly from an uppermost end to the bottom wall, and the upper side wall portion having an outwardly stepped generally rectangular non-tapered outer wall portion immediately above the uppermost end of the lower side wall portion, and a further outwardly stepped cylindrical outer wall portion immediately above the outwardly stepped generally rectangular outer wall portion to provide laterally outwardly extending flanges between the stepped cylindrical outer wall portion and the stepped generally rectangular non-tapered outer wall portion that are engageable by a generally U-shaped lifting yoke.

17. The inertial barrier of claim 16 further comprising a plurality of circumferentially spaced axially and inwardly extending ribs in the lower side wall portion to give the lower side wall portion added strength and rigidity.

18. The inertial barrier of claim 17 wherein at least some of the ribs in the lower side wall portion progressively increase in width and depth from top to bottom.

19. An inertial barrier for use in protecting a vehicle from roadway hazards comprising a plastic container having a bottom wall and open top and a side wall, a ledge extending laterally inwardly from the side wall in spaced relation from the bottom wall and open top, and an insert having sides sized and shaped to be supported by the ledge inside the container, the insert having an axially upwardly, radially inwardly extending top wall for supporting a dispersible granular energy absorbing material above the insert inside the container, wherein the container side wall includes an upper side wall portion that is stepped laterally inwardly at discrete intervals along its height from the open top, and a lower side wall portion that tapers inwardly from top to bottom to facilitate stacking of a plurality of such containers during transit or storage, and the upper side wall portion has an outwardly stepped generally rectangular non-tapered wall portion immediately above the lower side wall portion and a further outwardly extending cylindrical wall portion immediately above the stepped generally rectangular wall portion that forms laterally outwardly extending flanges immediately above the stepped generally rectangular wall portion.

* * * * *